United States Patent [19]

Cho

[11] Patent Number: 4,960,687

[45] Date of Patent: Oct. 2, 1990

[54] PROCESS OF MAKING PHOTOGRAPHIC SILVER HALIDE ELEMENT WITH BACKING LAYERS WITH IMPROVED COATING PROPERTIES

[75] Inventor: Thomas B. Cho, East Brunswick, N.J.

[73] Assignee: E. I. Du Pont de Nemours and Company, Wilmington, Del.

[21] Appl. No.: 414,420

[22] Filed: Sep. 29, 1989

[51] Int. Cl.[5] ..... G03C 1/82

[52] U.S. Cl. ..... 430/527; 430/523; 430/529; 430/534; 430/535; 430/537; 427/154; 427/155; 427/199; 427/302; 427/331; 427/339; 427/340

[58] Field of Search ..... 430/523, 527, 529, 534, 430/535, 537; 427/154, 155, 299, 302, 331, 338, 339, 340

[56] References Cited

U.S. PATENT DOCUMENTS

| | | | |
|---|---|---|---|
| 3,891,308 | 1/1990 | Cho | 430/527 |
| 4,225,665 | 9/1980 | Schadt | 430/529 |
| 4,585,730 | 4/1986 | Cho | 430/527 |
| 4,701,403 | 10/1987 | Miller | 430/529 |

*Primary Examiner*—Jack P. Brammer

[57] ABSTRACT

An improved process for the preparation of backing layers with improved coating qualities is described. These layers are designed to transmit antistatic properties from antistatic layers coated under the backing layers and provide antihalation or anticurl effects in addition thereto. The process of this invention includes in-line addition of a pre-stabilized crosslinking solution to a gelatino-conductive polymer solution just prior to the coating thereof. Smooth, skip-free coatings are obtained and the solutions are stable and can be maintained for long periods of time.

7 Claims, No Drawings

PROCESS OF MAKING PHOTOGRAPHIC SILVER HALIDE ELEMENT WITH BACKING LAYERS WITH IMPROVED COATING PROPERTIES

BACKGROUND OF THE INVENTION

Cross-Reference to Related Applications

This application is related to Cho, U.S. Pat. No. 4,585,730, "Antistatic Backing Layer with Auxiliary Layer for a Silver Halide Element", granted Apr. 29, 1986. This application is also related to Miller, U.S. Pat. No. 4,701,403 granted Oct. 20, 1987, which is directed to a process for applying a thin, clear antistatic layer to a photographic film over which the layer of this invention may be applied. This invention is also related to Cho, U.S. Pat. No. 4,891,308, filed Apr. 14, 1989, and entitled "Photographic Film Antistatic Backing Layer with Auxiliary Layer Having Improved Properties" and is an improvement thereover.

FIELD OF THE INVENTION

This invention relates to a photographic film. More particularly this invention relates to a photographic film having an improved auxiliary backing layer for said film, one that can conduct antistatic properties from an antistatic underlayer to the surface thereof and which can be applied thereto without premature cross-linking and without producing slugs and other deleterious material during the manufacture thereof.

BACKGROUND OF THE INVENTION

Polymeric film supports for photographic film are known for their propensity to accumulate static charges. This is a particular problem where the film is designed to be handled by machine and to be processed rapidly over unlike surfaces. Static charges which may be generated at this time cannot be readily tolerated because discharging these may expose the photographic layer, or layers, coated thereon. The use of so-called antistatic layers to prevent the build-up of these static charges is well known in the art. Schadt, U.S. Pat. No. 4,225,665, describes one such composition comprising a mixture of (1) a water-soluble copolymer of the sodium salt of styrene sulfonic acid and a carboxyl-containing monomer, (2) a hydrophobic polymer containing carboxyl groups, and (3) a water-soluble polyfunctional aziridine. When this mixture is applied as a single layer to resin-subbed (resin-subcoated)poly(ethylene terephthalate), for example, it provides excellent protection from the build-up of static charges (e.g. surface resistivity).

Miller, U.S. Pat. No. 4,701,403 describes an improvement over the aforementioned Schadt patent wherein a polymer such as component (1), for example, is applied to the support in a first coating, optionally a composition containing component (2), and, after drying, aziridine component (3) is applied as a second coating contiguous thereto. This improved process permits the application of thinner antistatic layers without premature reaction of the aziridine with the other ingredients. Products from such premature reaction can sometimes plug and foul coating equipment, which is not commercially tolerable.

Cho, U.S. Pat. No. 4,585,730 describes an auxiliary layer consisting essentially of gelatin binder containing various conductive polymers as described. This layer is satisfactory in transporting antistatic properties from underlayers to the surface thereof. However, occasionally the layer described in this patent suffers from certain disadvantages such as problems with anchorage and poor processability in the fluids in which the photographic layer is processed.

Cho, U.S. Ser. No. 07/344,974, filed Apr. 14, 1989, describes an even more preferred auxiliary layer in which the ingredients of said layer, which include a crosslinkable conductive polymer having functionally attached carboxylic acid groups and a crosslinking agent for said conductive polymer all dispersed in a gelatin binder and coated at a pH of 3 to 12. Although this is a functional element, the process of applying this mixture can be fraught with problems during coating since premature reactions occur between the crosslinking agent, the polymer and gelatin prior to the coating thereof. These reactions cause the formation of so-called "gel slugs" which tend to plug the coating devices and cause streaks and other unwanted defects. These defects cannot be tolerated during commercial operation thereof.

Thus, it is desired to provide a process which will permit the application of auxiliary layers over conventional antistatic layers which will maintain all the requisite antistatic properties and which can be applied with the aforementioned problems.

SUMMARY OF THE INVENTION

In accordance with this invention there is provided a process for preparing a photographic film comprising a support, at least one silver halide emulsion coated on one side of said support, and on the opposite side of said support, in order, are (a) a layer containing an antistatic agent and (b) an auxiliary layer consisting essentially of at least one crosslinkable, conductive polymer having functionally attached carboxylic acid groups selected from the group consisting of poly(sodium styrene sulfonate-maleic anhydride), hexadecyl betaine, alkyldimethyl betaines, carboxylated imidazolines, coco amido betaines, and mixtures thereof, and a polyfunctional aziridine crosslinking agent therefor, dispersed in gelatin, the process comprising maintaining separate said crosslinking agent from said at least one conductive polymer and said gelatin and stabilizing said crosslinking agent at a pH of 9.0 to 11.5 and then combining said separated components just prior to the coating thereof on the antistatic layer whereby a smooth, defect free coating is obtained.

DETAILED DESCRIPTION OF THE INVENTION

Consisting essentially of, as used herein, means that unspecified constituents or conditions are not excluded, provided that they do not affect the advantages of this invention from being realized.

The crosslinkable, conductive polymer may be present alone or in combination with at least one other crosslinkable, conductive polymer. A particularly preferred crosslinkable, conductive polymer is poly(sodium styrene sulfonate-maleic anhydride). Other crosslinkable, conductive polymers include: hexadecyl betaine; alkydimethyl betaines wherein the alkyl is from 1 to 12 carbon atoms; carboxylated imidazolines; cocoamido betaines; etc. These conductive polymers, which also contain functionally attached carboxylic acid groups, may be added to the auxiliary layer of this invention in a range of 0.5 to 30% by weight of the gelatin binder, and preferably at 2 to 5% by weight. The term "gelatin binder" denotes a binder wherein the major component is gelatin. Gelatin substitutes, e.g., polyvinyl alcohol; dextran; cellulose derivatives; modified gelatins; water-soluble acrylic latex; etc., may be present in minor amounts, e.g., less than 17% by weight.

The crosslinking agents which provide the ultimate in crosslinking effects between the conductive polymer, the gelatin present and the antistatic layer over which the auxiliary layer of this invention is to be applied, are the polyfunctional aziridines, such as those described in Schadt, U.S. Pat. No. 4,225,665 and Miller, U.S. Pat. No. 4,701,403, the disclosures of which are incorporated herein by reference. These agents may be present in an amount of 0.5 to 5.0% by weight of the gelatin binder and preferably in an amount of 1.0 to 3.0% by weight.

A mixture of the gelatin binder in water, and the crosslinkable conductive polymer, is made up prior to coating. Other additives (e.g. antihalation dyes, surfactants, wetting agents, and hardeners or crosslinking agents for gelatin) may also be present. At this point, just prior to coating, the pH is adjusted to 5.0 to 8.0 and preferably a pH of 6.0 to 7.5.

The crosslinking aziridine agent is made up in a separate vessel and is preferably dissolved in a mixture of alcohol and water and the pH adjusted to 9.0 to 11.5, preferably a pH of 9.0 to 10.0. It is important to adjust the pH within this critical range since the aziridine must be stable and below pH of about 8.9, the aziridine ring begins to degrade by ring opening.

The solution containing the aziridine crosslinking agent is then added to the gelatin containing the conductive, crosslinkable polymer just prior to coating. This step may easily be accomplished using the so-called "in-line injection" method. By preventing the early mixing of ingredients, and by using the aforesaid stabilization process for maintaining the integrity of the crosslinking agent, a smooth, skip or defective-free coating is obtained.

The aqueous coating composition made as described above may be applied with good results to any of the conventional photographic film supports but the preferred support is poly(ethylene terephthalate) subcoated with a layer or layers of conventional resins and containing the antistatic coatings of Miller, U.S. Pat. No. 4,701,403, etc. The invention is not limited to any particular antistatic coating; however, the antistatic coatings of the aforesaid Miller patent are preferred (see particularly Column 3, line 56 to Column 4, line 56, the disclosure of which is incorporated herein by reference). The backing layer of this invention is then coated over the antistatic layer at a coating weight of about 30 to 90 mg/dm$^2$, preferably about 40 to 60 mg/dm$^2$.

Thus, in a particularly preferred mode, this invention is represented by an element which comprises a support, which is preferably dimensionally stable polyethylene terephthalate suitably subbed on both sides with a thin, anchoring substratum of a conventional resin sub over which may be applied a gelatin sublayer. On one side of this support a standard silver halide emulsion layer may be applied and this layer then overcoated with a protective overcoat layer, e.g., a conventional hardened gelatin, abrasion layer. On the side opposite to the side containing this emulsion layer, the antistatic layer of the aforementioned Miller patent is preferably applied followed by a layer represented by this invention. As stated previously, the layer of this invention may also be an antihalation layer or may be coated simply a gelatin anti-curl layer, as is well-known to those of normal skill in the art.

When the layer of this invention is made as taught herein, many advantages are obtained. First, this layer will provide transmission of antistatic properties from the antistatic layer to the surface of the film as is desired. Next, the layer of this invention is stable and will survive the rigors of photographic processing without disintegration. This is a very desirable trait since prior art layers tended to flake off during the processing steps. This loss of layer integrity is a defect that cannot be tolerated since particles of the layer tend to foul the processing fluids and, more importantly, cause loss of antistatic transmission properties. Additionally, the adhesion between previously coated or subsequently coated layers is enhanced by the layer of this invention over those of the prior art. Finally, as made by the process taught herein, coating speeds and quality are vastly improved over the prior art references and processes disclosed herein. By stabilizing the aziridine crosslinking agent and maintaining a separation between this agent and the conductive polymer and gelatin, and mixing the two just prior to coating, the layers are stable and free from coating defects and there is no need to filter solutions prior to coating. It is also possible to hold and maintain the solutions containing their separate ingredients for a longer period of time thus improving the entire coating operation and savings in time and investment. This is surprising since it was not well-known that the stabilization of the aziridine crosslinking agent would react so prematurely with the other ingredients. It was also not known that the stability of the aziridine agents were so dependent on pH. By following the teachings of this invention, the viscosity of the solutions involved is closely controlled and the stability vastly improved. These improvements aid greatly in the commercial operations involved in the coating of this type of solution.

A host of conventional photosensitive materials may be present as the emulsion layer described above. These include photopolymer, diazo, vesicular image-forming materials, etc. The films described may be used in any of the well-known imaging fields such as graphic arts, printing, medical and information systems, among others. The photographic film of this invention is particularly useful in processes where rapid transport and handling by machines are practiced such as phototypesetting applications, for example. Particularly useful elements include the so-called "bright-light" films which can be handled in relatively bright safelights, for example. This invention will now be illustrated by the following examples of which Example 1, Sample 3 is considered to be a preferred mode.

EXAMPLE 1

A backing layer solution was prepared by mixing the following ingredients:

Solution A: (gelatino-conductive polymer solution)

| Ingredient | Amount (g) |
|---|---|
| distilled water | 12,060 |
| Conductive Polymer (sodium-[polystyrene sulfonate]-maleic anhydride) 25% solution in water, No. average MW ca. 3,000, determined by known osometry techniques. | 168 |
| gelatin | 1,200 |
| silica matte (12 mμ, | 6.6 |

-continued

| Solution A: (gelatino-conductive polymer solution) | |
|---|---|
| Ingredient | Amount (g) |
| Davidson Chem. Co.) | Mix together |
| distilled water | 300.0 |

These ingredients were digested together for 15 minutes at room temperature and then for 25 minutes at 130° F. (~55°).

| Solution B: (other ingredients for backing) | |
|---|---|
| Ingredients | Amount (g) |
| ethyl alcohol | 580 |
| distilled water | 580 |
| 5% aqueous solution of perfluoroalky carboxylate (FC-127 ®, 3M Co.) | 270 |
| benzenesulfonic acid, 4-[4,5-dihydro-4-[[5-hydroxy-3-methyl-1-(4-sulfophenyl)-1H-pyrazol-4-yl]methylene]-3-methyl-5-oxo-1H-pyrazol-1-yl]-, dipotassium salt Yellow Dye (1) (16% soln) | 138 |
| Acid Violet Dye (2) (12% soln) | 150 |
| 3N sodium hydroxide | 32 |
| 4.2% aqueous solution of sodium octyl phenoxy diether sulfonate wetting agent (Triton ® X200, Rohm & Haas Co.) | 600 |
| 6% aqueous solution of sodium myristyl triether sulfate wetting agent (Standapol ® ES40, Henkel, Inc., USA) | 300 |
| polyethyl acrylate latex (32.5% solution in water) | 1,320 |
| chromium potassium sulfate (12.5% solution in water) | 60 |
| gelatin | 1,200 |
| distilled water | 13,240 |

These ingredients were also mixed thoroughly and then Solution A added to Solution B at 100° F. (~38° C.) while stirring to mix. The pH of the final mixture was 6.52.

An additional dye solution of 2% benzenesulfonic acid, 4-[4,5-dihydro-4-[5-hydroxy-3-methyl-1-(4-sulfophenyl)-1H-pyrazol-4-yl]-2, 4-pentadienylidene]-3-methyl-5-oxo-1H-pyrazol-1-yl]-, Blue Dye (3) was made up and kept separate.

A separate solution containing the aziridine crosslinking agent was made up as follows:

| Ingredient | Amount (g) |
|---|---|
| distilled water | 670 premixed |
| ethyl alcohol | 380 |
| 3N sodium hydroxide | 30 |
| 1-aziridinepropanoic acid, 2-methyl-2-ethyl-2-[3-(2-methyl-1-aziridinyl)-1-oxopropoxy]-1,3-propandiyl ester CAS #64-265-57-2, formula $C_{24}H_{41}N_3O_6$) MW 467.61-hereinafter referred to as "PFAZ322" | 50 |

These ingredients were thoroughly mixed and the pH was 10–11.5.

Yellow Dye (1)

-continued

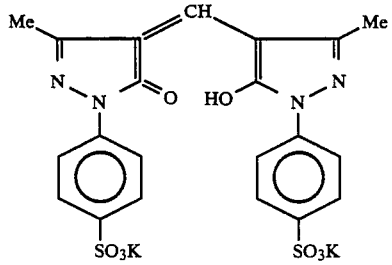

Acid Violet Dye (2)

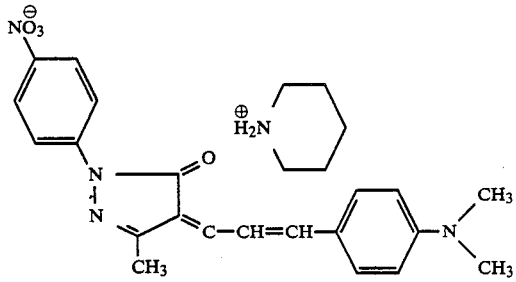

Blue Dye (3)

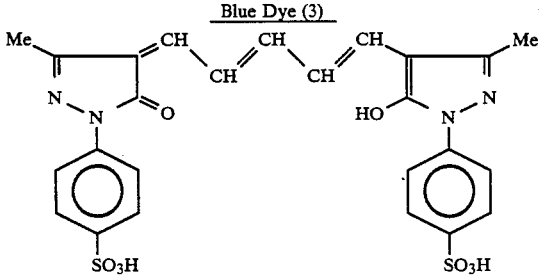

The three solutions (gelatino-conductive polymer containing two of the requisite antihalation dyes; a solution containing the third of the dyes; and the crosslinking agent) were held in separate vessels. A sample of dimensionally stable and resin/gel subbed polyethylene terephthalate film on which an antistatic layer similar to that previously described in Miller U.S. Pat. No. 4,701,403 had been applied, was used as the support for this coating. The solution containing the gelatino-conductive polymer was passed first through a line to the coating station. Just prior to that coating station, the solution of the third dye and the crosslinking agent were in-line injected so that mixing of all three solutions occurred just at said coating station. Coating was continued under varying levels of the rate of in-line injection for the crosslinking agent only, as shown below. Samples were taken of the coated stock at each point and an assessment made of the coating quality, the strength of layer adhesion and the surface resistivity, as measured by Cho, U.S. Pat. No. 4,585,730, the disclosure of which is incorporated herein by reference, also determined. In addition, a conventional, gelatino-silver halide emulsion layer was applied on the side opposite to that containing the antistatic and auxiliary, antihalation layer and a determination of sensitometry and suitability also determined. For control purposes, another experiment utilizing the same ingredients, but wherein all ingredients were premixed prior to coating, was also made. Samples were obtained at the following points:

| Sample | Amt. PFAZ322 Injected (g/200 g gel) |
|---|---|
| Control | None—all premixed |
| 1 | 0.5 |
| 2 | 1.0 |
| 3 | 2.5 |
| 4 | 4.0 |
| 5 | 5.0 |
| 6 | 6.0 |

In the case of the Control, the coating was hard to manage since over a period of time, gel slugs clogged the coating bar and caused coating streaks to appear. The coating had to be shut down from time to time to clear the coating bar. Additionally, although the coating had good static resistance, there was loss of product due to poor coating performance. Finally, in the Control, the coating was less efficient since this material required higher drying times.

In the samples representing this invention, there were no slugs or coating skips and the drying was much faster than that of the control, resulting in an increase of 12.5% thereover. The static protection was excellent and the adhesion superb. All the sensitometric results from photographic coatings were within specifications. All samples processed well with no delamination of layers. Thus, the crosslinking effect was the same over a wide range of crosslinking agent.

EXAMPLE 2

In this experiment, a purified form of the conductive polymer described in Example 1 was used. This purified sample was made by National Starch Co. purified to remove excess sodium sulfonate. The solutions were prepared similar to those described in Example 1 and equivalent and excellent results were achieved.

EXAMPLE 3

To test the effect of yet another conductive polymer, coco amido betaine was substituted for the sodium(polystyrene sulfonate) maleic anhydride of Example 1. Additionally, a mixture of both conductive polymers was also made. All other ingredients were identical. The crosslinking agent was again added by in-line injection. Equivalent and excellent results to that of Example 1 were achieved.

EXAMPLE 4

In this example, the aziridine crosslinking agent was replaced with pentaerythritol-tri-beta-(2-methyl aziridine). All other ingredients and conditions were the same. The crosslinking agent solution was added by in-line injection. Equivalent and excellent results to that of Example 1 were obtained.

I claim:

1. A process for preparing a photographic film comprising (a) coating on a support at least one silver halide emulsion layer, and (b) coating on the opposite side of said support, in order, (1) a layer containing an antistatic agent and (2) an auxiliary layer consisting essentially of at least one crosslinkable, conductive polymer having functionally attached carboxylic acid groups selected from the group consisting of poly(sodium styrene sulfonate-maleic anhydride), hexadecyl betaine, alkyldimethyl betaines, carboxylated imidazolines, coco amido betaines, and mixtures thereof, and a polyfunctional aziridine crosslinking agent therefor, dispersed in gelatin, with the proviso that until just prior to coating auxiliary layer (2) on the antistatic layer (1), whereby a smooth, defect-free coating is obtained, the polyfunctional aziridine crosslinking agent is maintained separate from said at least one crosslinkable conductive polymer and said gelatin and is stabilized at a pH of 9.0 to 11.5, and the stabilized aziridine crosslinking agent is combined with said at least one crosslinkable, conductive polymer and said gelatin.

2. A process according to claim 1 wherein said at least one conductive polymer is present in a range of 0.5 to 30% by weight based on the weight of gelatin present and said crosslinking agent is present in a range of 0.5 to 5% by weight based on the weight of gelatin present.

3. A process according to claim 1 wherein said pH of said crosslinking agent is adjusted to 9.0 to 10.0.

4. A process according to claim 1 wherein said conductive polymer is poly(sodium styrene sulfonate-maleic anhydride) and said aziridine crosslinking agent is 1-aziridinepropanoic acid, 2-methyl-2- ethyl-2-[3-(2-methyl-1-aziridinyl)-1-oxopropoxy]-1,3-propandiyl ester.

5. A process according to claim 1 wherein said conductive polymer is coco amido betaine and said crosslinking agent is pentaerythritol-tri-beta-(2-methyl aziridine).

6. A process according to claim 1 wherein said support is a polyethylene terephthalate and said photographic emulsion is covered with a protective overcoat layer.

7. A process according to claim 1 wherein said auxiliary layer additionally contains antihalation dyes therein.

* * * * *